US006669510B2

(12) United States Patent
Yamawaki et al.

(10) Patent No.: US 6,669,510 B2
(45) Date of Patent: Dec. 30, 2003

(54) STRUCTURE FOR LOCKING TWO WORKPIECES

(75) Inventors: Takanori Yamawaki, Shizuoka (JP); Takeo Kohata, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/207,766

(22) Filed: Jul. 31, 2002

(65) Prior Publication Data

US 2003/0027456 A1 Feb. 6, 2003

(30) Foreign Application Priority Data

Jul. 31, 2001 (JP) ..... 2001-232009

(51) Int. Cl.[7] ..... H01R 13/422
(52) U.S. Cl. ..... 439/595; 439/357
(58) Field of Search ..... 439/595, 752, 439/350–358

(56) References Cited

U.S. PATENT DOCUMENTS 5,716,234 A * 2/1998 Phillips ..... 439/595
5,931,700 A * 8/1999 Saito et al. ..... 439/595
6,152,768 A * 11/2000 Beugnot et al. ..... 439/595

FOREIGN PATENT DOCUMENTS

JP 7-50180 2/1995

* cited by examiner

*Primary Examiner*—Gary Paumen
(74) *Attorney, Agent, or Firm*—Armstrong, Kratz, Quintos, Hanson & Brooks, LLP

(57) ABSTRACT

A structure for locking two workpieces includes: a first workpiece 1 provided with a provisional locking arm 3 and a complete locking arm 4 which are in parallel; a second workpiece 2 provided with an arm receiving portion 5 having a provisional engaging area 15 and a complete engaging area 12 which are to be engaged with the provisional locking portion and the complete locking portion, respectively and a pair of arm guiding portions 6 and 7 on both sides of the arm receiving portion, the arm receiving portion being to advance in between the provisional locking arm and the complete locking arm. One of the arm guiding portions is provided with a slope 21 for slidably supporting a tip of the complete locking arm when the complete locking arm climbs over the complete engaging portion. In such a configuration, inadvertent complete-locking or release thereof of two workpieces can be prevented.

5 Claims, 4 Drawing Sheets

STRUCTURE FOR LOCKING TWO WORKPIECES

BACKGROUND OF THE INVENTION

1. Field of the Invention

This invention relates to a structure for locking provisionally and completely two workpieces such as a corrector housing and front holder.

2. Description of the Related Art

FIG. 8 shows an example of a conventional holder-equipped connector. A holder-equipped connector 51 includes a connector housing 52 of synthetic resin and a front holder 53 of synthetic resin that is inserted in the connector housing 52 from the front to form a terminal chamber 54.

The connector housing 52 internally includes a holder inserting chamber 55, a rear half 56 of the terminal chamber 54 which is successive to the inserting chamber 55 and a terminal locking lance 57 which projects into the holder inserting chamber 55. The connector housing 52 is externally provided with a locking arm 58 corresponding to a complementary female connector (not shown).

The front holder 53 has an end wall, upper and lower walls and an intermediate partition wall. A hole 59 through which a male terminal (not shown) of a complementary male connector is formed in the end wall. In the specification, a connector having a connector chamber is defined as a female connector while another connector which is to be inserted into the connector chamber is defined as a male connector.

The front holder 53 is inserted into the connector housing 52 from its front, and fixed within the holder inserting chamber 55 by a fixing means (not shown). Subsequently, a wire-equipped terminal 60 is inserted into the terminal chamber 54, and locked by a locking lance 57.

Since the connector housing 52 and front holder 53 are formed as individual bodies, a complicate shape such as the locking lance 57 within the connector can be easily formed in a large scale.

Various formats have been proposed for locking the connector housing 52 and front holder 53 to each other. FIGS. 9 and 10 show a format of a locking structure for a holder-equipped connector.

In FIG. 9, reference numeral 61 denotes a connector housing and reference numeral 62 denotes a front holder. The connector housing 61 has an open space 63. On the one inner wall thereof, a provisional locking projection 64 is formed, whereas on the other inner wall thereof, a complete locking projection 65 is formed. The provisional locking projection 64 and he complete locking projection 65 are formed in order from the entrance of the open space. The front holder 62 is equipped with a projecting arm 66 that approaches into the open space 63. The arm 66 is equipped with a provisional locking projection 67 on the one side and a complete locking projection 68 on the other side. The arm 66 has a slit-like hole (hollow portion) 69 formed at its center so that the locking projections 67 and 68 can warp inwardly.

As seen from FIG. 9, when the provisional locking projection 67 of the front holder 62 has climbed over the provisional locking projection 64, the complete locking projections 65 and 68 are brought into contact with each other so that the front holder 62 is provisionally locked to the connector housing 61. The connector housing 61 and front holder 62, while they are in the provisionally locked state, are transported to the subsequent step.

In the subsequent step, as shown in FIG. 10, the front holder 62 is completely pushed into the connector housing 61. The complete locking projection 68 climbs over the complete locking projection 65 so that the rear end of the complete locking projection 68 is brought into contact with the rear end of the complete locking projection 68, and an end face 70 on the bottom side of the front holder 62 is brought into contact with the front end face 71 of the connector housing 61. Thus, the front holder 62 is completely locked to the connector housing 61. In the specification, the direction of inserting the terminal and front holder 62 into the connector housing 61 is defined as "front".

However, in the conventional locking structure of the holder-equipped connector, the pushing force required to secure the front holder 62 provisionally is substantially equal to that required to secure the front holder 62 completely. Owing to this, where the front holder 62 provisionally locked to the connector housing 61 is transported in e.g. an automated assembling machine, the front holder 62 may interfere with the outside so that the front holder 62 is inadvertently pushed in the connector housing 61. In this case, an operator must release the complete locking using a jig bar or the like. This is very troublesome.

It is preferred that the provisional locking can be done easily and the complete locking can be done surely with the aid of great force. However, conventionally, the complete locking force of the front holder 62 is small so that the front holder 62 is apt to be inadvertently released owing to vibration while the vehicle runs.

In addition, since the slit-like holder (hollow portion) must be formed as the center in the width direction of the arm 66 of the front holder 62, moldability of the arm is poor during resin molding of the front holder 62. This requires a complicate mold and hence increases the production cost.

In other cases than locking of the front holder 62, e.g. inserting a spacer for doubly locking a terminal in the connector or electric connection box, provisional locking means and complete locking means are required. In these cases also, the above problem occurs.

SUMMARY OF THE INVENTION

An object of this invention is to provide a structure for locking two workpieces which does not inadvertently secure completely two workpieces such as a front holder and a connector housing when they are locked to each other and can surely secure them completely with the aid of great force, and can be resin-molded easily and at low cost.

In order to attain the above object, in accordance with this invention, there is provided a structure for locking two workpieces comprising:

- a first workpiece provided with a provisional locking arm and a complete locking arm which are in parallel;
- a second workpiece provided with an arm receiving portion having a provisional engaging area and a complete engaging area which are to be engaged with the provisional locking arm and the complete locking arm, respectively and a pair of arm guiding portions on both sides of the arm receiving portion, the arm receiving portion being to advance in between the provisional locking arm and the complete locking arm, wherein one of the arm guiding portions is provided with a slope for slidably supporting a tip of the complete locking arm when the complete locking arm climbs over the complete engaging portion.

In the above configuration, the provisional locking arm is first engaged with the provisional engaging area of the arm receiving portion so that both workpieces are provisionally locked to each other. Next, as the first and/or the second workpiece are pushed in a combining direction, the complete locking arm warps outwardly while the complete locking arm climbs over the complete engaging area of the arm receiving portions and the outer area at the tip of the complete locking arm is brought into contact with the slope of the arm guiding portion so that the complete locking arm is supported in the sloped state on both ends. This increases the force required to warp the complete locking arm so that greater force is required for the complete locking than for he provisional locking. Thus, inadvertent shift from the provisional locking to the complete locking can be prevented. The complete locking arm climbs over the complete engaging area so that the former is engaged with the latter. Accordingly, both workpieces are completely locked to each other. When the complete locking is released, the outer area at the tip of the complete locking arm is in contact with the slope of the arm guiding portion so that the complete locking arm is supported on both ends. Therefore, greater force is required to release the complete locking than to release the provisional locking. Thus, inadvertent release of the complete locking can be prevented. Further, the pair of locking arms advance or retreat along the arm receiving portion and the arm guiding portions on the both sides thereof so that the pair of locking arms can be accurately positioned. This permits the provisional locking force and the complete locking force to be accurately specified.

In a preferred embodiment of this invention, the provisional locking arm has a provisional locking area at its tip, the complete locking arm has a complete locking area at its middle position in the longitudinal direction, the arm receiving portion has the provisional engaging area at its tip and the complete engaging area behind the provisional engaging area.

In the above configuration, when the provisional locking area of the provisional locking arm climbs over the provisional engaging area so as to be engaged with it, the complete locking area of the complete locking arm is brought into contact with the area of the arm receiving portion. This surely gives the provisional locked state with no backlash.

In a preferred embodiment, the provisional locking arm and the arm guiding portion have releasing slopes at their tips, respectively.

In the above configuration, when the provisional locking area of the provisional locking arm climbs over the provisional engaging area of the arm receiving portion so that the provisional locking arm warps outwardly, the slope of the outer area at the tip of the provisional locking arm passes smoothly along the slope of the inner area at the tip of the other arm guiding portion. Therefore, the provisional locking can be easily done with small force.

In a preferred embodiment of this invention, the provisional locking area and the complete locking area are formed as projections.

This configuration surely realizes the engagement between the provisional locking area and provisional engaging area in the provisional locking and the contact between the complete locking area and the complete engaging area. In addition, in the complete locking, the provisional locking portion smoothly moves straight along the arm receiving portion so that the complete locking area is surely engaged with the complete engaging area.

In a preferred embodiment of this invention, the first workpiece is a connector housing and the second workpiece is a front holder which defines a terminal chamber in the connector housing.

Owing to the above configuration, since the complete locking of the front holder to the connector housing is performed with greater force than the provisional locking thereof, the inadvertent pushing (complete locking) of the front holder and release thereof can be prevented.

The above and other objects and features of this invention will be more apparent from the following description taken in conjunction with the accompanying drawings.

DESCRIPTION OF PREFERRED EMBODIMENT

Figure 2:
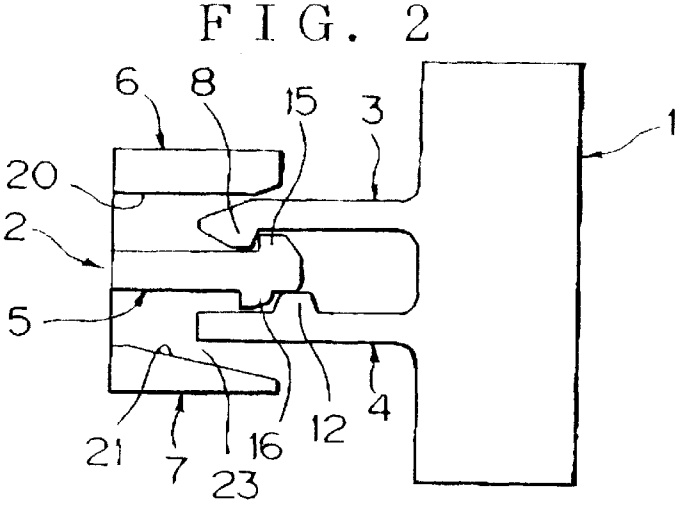
FIG. 2 is a plan view of the provisional state of the locking structure.

Now referring to the drawings, a detailed description will be given of an embodiment of this invention.

FIGS. 1 to 4 show an embodiment of a structure for locking two workpieces according to this invention.

Figure 1:
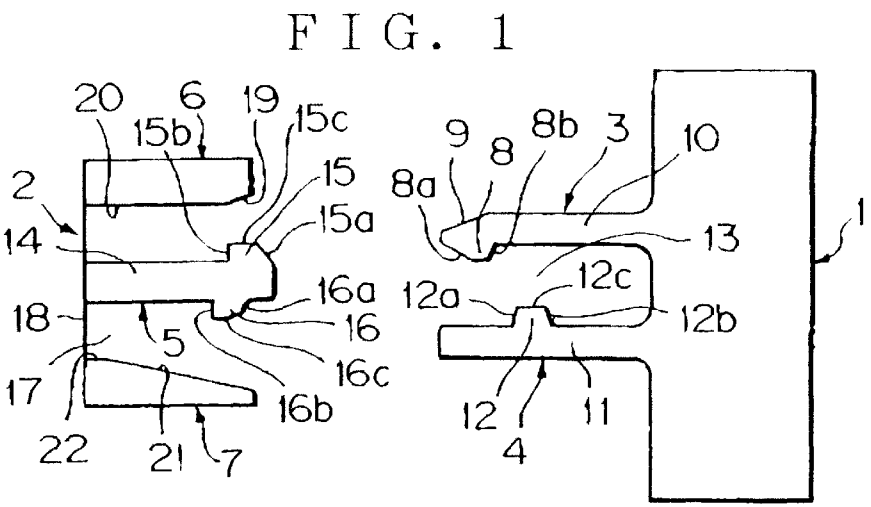
FIG. 1 is a plan view of a locking structure of two workpieces according to this invention.

As seen from FIG. 1, this structure includes a provisional locking arm 3 and a complete locking arm 4 which constitute a pair of left and right resilient arms and are integral to an workpiece 1, an arm receiving portion 5 which is attached to another workpiece 2 and adapted to approach in between the provisional locking arm 3 and the complete locking arm 4, a first arm guide 6 which is a straight body attached to another workpiece 2 and located on the one side of the arm receiving portion 5 and a second arm guide 7 which is a sloped body attached to located on the other side of the arm receiving portion 6.

The provisional locking arm 3 and complete locking arm 4 project straight and in parallel as cantilever beams with equal lengths. A provisional locking projection (provisional locking portion) 8 is formed integrally to the inside of the tip of the one provisional locking arm 3, whereas a slope for releasing is formed integrally to the outside of the tip.

The provisional locking projection 8 is formed in a triangular shape to have a sloped face 8*a* (relatively gentle slope) sloping inwardly at an acute angle from the tip of the arm and a locking face 8*b* which crosses the internal face of the straight arm 3 with an obtuse angle at a short distance from the apex of the sloped face 8*a*. The sloped face 8*a* serves as a contact and sliding face for the arm receiving portion 5.

The complete locking arm 4 has a complete locking protection (complete locking portion) 12 located at an intermediate position in the longitudinal direction of an beam-like arm body 12. The complete locking projection 12 is formed integrally to the internal face of the arm body 11. The complete locking projection 12 is located at a position slightly apart rearward from the provisional locking projection 8 in the longitudinal direction of the arm body 12. The complete locking projection 12 has a trapezoidal shape composed of front and rear sloped faces 12*a*, 12*b* and an intermediate straight face 12*c*. The front and rear slopes 12*a* and 12*b* cross the internal face of beam-like body 11 at an angle equal to that of the locking face 8*b* of the provisional locking projection 8. The sloped face 19*a* serves as a contact and sliding face for the arm receiving portion 5, whereas the rear sloped face 12*b* serves as a locking face.

A slit 13 is provided between the provisional locking projection 8 and the complete locking projection 12. These projections inwardly protrude at approximately equal lengths.

The arm receiving portion 5 on the side of the other workpiece 2 is composed of a single straight rail- or pole-like receiving body 14, a provisional engaging projection (provisional engaging portion) 15 and a complete engaging projection (complete engaging portion) 16. These projections are formed integrally to the tip of the receiving body 14. The provisional locking projection 15 is located as the tip of the arm receiving body 14 on the one side thereof so as to be opposite to the provisional locking projection (provisional locking portion) 8 of the provisional locking arm 3. The complete engaging projection 16 is formed on the other side of the arm receiving body 14 so as to be opposite to the complete locking projection 12 of the complete locking arm 4. The complete engaging projection 16 is located at a position slightly rearward or closer than the provisional engaging projection 15 to the bottom of the arm receiving portion 5.

The provisional engaging projection 15 has a sloped face 15*a* at the tip of the receiving body, a straight face 15*c* successive to the sloped face 15*a* and a rear locking face 15*c* which is orthogonal to the one side of the receiving body 14. The sloped face 15*a* is formed at a gradient which is more steep than that of the sloped face 8*a* of the provisional locking projection 8, and can be brought into contact with the tip of the provisional locking arm 3 with relatively strong force. In this specification, the directions of fitting the workpieces 1 and 2 to each other are defined as "front".

The complete engaging projection 16 has a first sloped face 16*a* which is relatively short and located on the tip of the receiving body 14, a second sloped face 16*c* which is relatively long and extends to slope rearward from the first sloped face 16*a* and a locking face 16*b* which is orthogonal the other side of the receiving body 14 from the second sloped face 16*c*.

These projections 15 and 16 outwardly protrude at approximately equal lengths. The first sloped face 16*a* of the complete engaging projection 16 and the intermediate portion in the longitudinal direction of the provisional engaging projection 15 are located on the same line in the width direction of the arm receiving portion 5. The rear locking face 15*b* of the provisional engaging projection 15 and the intermediate portion in the longitudinal direction of the complete engaging projection 16 are located on the same line. The rear locking face 16*b* of the complete engaging projection 16 is located more slightly rearward than the locking face 15*b* of the provisional engaging projection 15.

A first arm guide 6 and a second arm guide 7 are arranged outside the arm receiving portion 5. The first arm guide 6 is located so as to be opposed to the one side of the arm receiving portion 5 on which the provisional engaging projection 15 is formed. The second arm guide 7 is located so as to be opposed to the other side of the arm receiving portion 5 on which the complete engaging projection 16 is formed. Both arm guides 6 and 7 are equal in length and slightly shorter than that of the arm receiving portion 5. The tips of both arm guides 6 and 7 and the intermediate portion in the longitudinal direction of the provisional engaging projection 15 are located on the same line. The arm receiving portion 5 and both arm guides 6, 7 may be vertically projected from the horizontal wall 17 or the other workpiece 2. Otherwise, they may be horizontally projected from the vertical base wall 18 of the other workpiece 2.

The first arm guide 6 has a short tapered slope 19 inside its tip. The slope 19 is formed at the same gradient as that of the slope 9 outside the provisional locking arm 3 so that the outside slope 9 of the provisional locking arm 3 in an outwardly warped state can pass without being in contact with the slope 19. The slope 19 of the arm guide 6 is successive to the straight inner face 20. The inner face 20 is located slightly outside the outer face of the provisional locking arm 3 in a free state (non-warped state). The slope 19 of the arm guide 6 is located oppositely to the straight face 15*c* of the provisional engaging projection 15 and has a length approximately equal to that of the straight face 15*c*.

The second arm guide 7 is located oppositely to the outer face of the arm receiving portion 5 on which the complete engaging projection 16 is formed. The second arm guide 7 has a long tapered slope 21 on its inside. The slope 21 extends from the tip of the arm guide 7 to the vicinity of the base thereof and the end thereof is successive to a short straight face 22. The slope 21 is located outside the outer face of the complete locking arm 4 in a free state. The straight face 22 is located substantially flush with the outer face of the complete locking arm 4.

In FIG. 1, where the other workpiece 2 is initially coupled with the one workpiece 1, the provisional locking arm 3 warps outwardly while the provisional locking projection 8 at the tip of the provisional locking arm 3 is in contact with the provisional engaging projection 15 at the tip of the arm receiving portion 5 (the slopes 8*a* and 15*a* at the tips of the projections 8 and 15 are in a sliding contact with each other). While the slope 9 on the outer face of the provisional locking arm 3 passes along the slope 19 on the inner face at the tip of the of the first arm guide 6, as shown in FIG. 2, the provisional locking projection 8 of the provisional locking arm 3 climbs over the provisional engaging projection 15 of the arm receiving portion 5, and advances in between the first arm guide 6 and the guide receiving portion 5. Thus, the locking faces 8*b* and 15*b* of both projections 8 and 15 are brought into contact with each other (FIG. 1).

Simultaneously, as seen from FIG. 2, the complete locking projection 12 of the complete locking arm 4 is brought into contact with the complete engaging projection 16 of the arm receiving portion 5. Both projections 12 and 16 are in contact with each other in their front slopes 12*a* and 16*a*. The outer face at the tip of the provisional locking arm 3 is substantially brought into contact with the inner face of the first arm guide 6 whereas the outer face at the tip of the complete locking arm 4 is located apart by a gap 23 from the inner slope 21 of the second arm guide 7. Since the provisional engaging projection 15 of the arm receiving portion 5 passes the provisional locking projection 8 of the provisional locking arm 3 and both projections 12 and 16 are brought into contact with each other, both workpieces 1 and 2 are provisionally locked to or coupled with each other.

Figure 3:
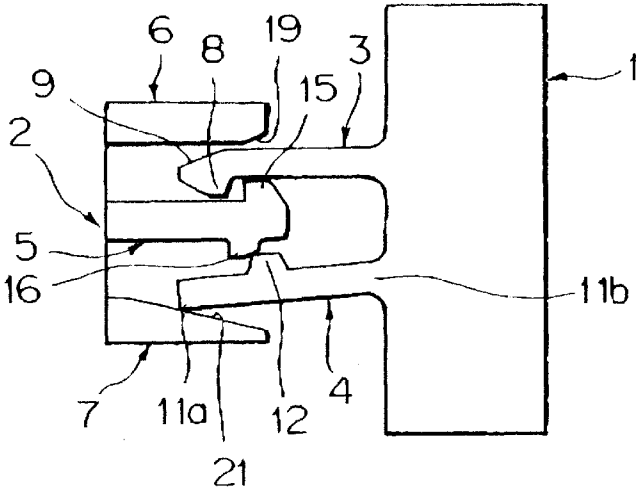
FIG. 3 is a plan view of the state on the way from the provisional locking to the complete locking in the structure.

Both workpieces 1 and 2 are further pushed into each other as shown in FIG. 3 from the provisional locked state of FIG. 2 in assembling directions. While the complete locking projection 12 climbs over the complete engaging projection 16 of the arm receiving portion 5, the outer portion 11*a* at the tip of the complete locking arm 4 is brought into contact with the inner slope 21 of the second arm guide 7. Thus, the complete arm 4 is supported at the front and rear terminals 11*a* and 11*b* so that it is changed from a cantilever beam into a normal beam (supported at both ends), thereby increasing the force required for warping the complete locking arm 4.

Specifically, the complete locking arm 4 is initially supported at only the base 11*b* so that it is warped as a cantilever beam while both projections 12 and 16 are in contact with each other. Thereafter, the complete locking arm 4 is supported at the tip 11*b* by the slope 21 of the arm guide 7 so that it is warped outwardly as the normal beam at the longitudinal intermediate portion at fulcrums of the front and rear tips 11*a* and 11*b* by contact and sliding between both projections 12 and 16, thereby increasing the warping force of the complete locking arm 4. Thus, since the force required for the complete locking becomes larger than that required for the provisional locking. Therefore, the locking structure will not be inadvertently shifted from the provisional locking state into the complete locking state which it is transported.

As relative pushing between both workpieces 1 and 2 is advanced, the complete locking arm 4 is largely warped outwardly at the fulcrums of both tips 11*a* and 11*b*. As seen from FIG. 4, the complete locking projection 12 of the complete locking arm 4 climbs over the complete engaging projection 16 of the arm receiving portion 5 and advances toward the rear of the complete engaging projection 16. Eventually, the locking faces 12*b* and 16*b* at the rear ends of both projections 12 and 16 are brought into contact with each other. While the complete locking arm 4 is restored straight, the outer face 11*a* at the tip of the complete locking arm 4 moves along the slope 21 of the arm guide 7 to reach the rear straight face 22 thereof.

The provisional locking arm 3 advances straight as it is along the first arm guide 6 from the state of FIG. 2 so that the provisional locking projection 8 of the provisional locking arm 3 advances along the outer face of the arm receiving portion 5. The guide receiving portion 5 advances in between the pair or locking arms 3 and 4 and the provisional engaging projection 15 of the guide receiving portion 5 advances along the inner face of the provisional locking arm 3.

Figure 4:
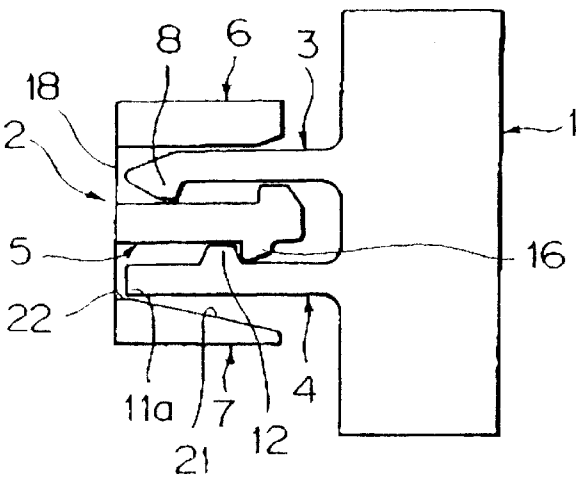
FIG. 4 is a plan view of the complete locking state of the structure.

Thus, the complete locking state of FIG. 4 results so that the other workpiece 2 is completely locked to the one workpiece 1. Since the complete locking projection 12 is in contact with the complete engaging projection 16, the other workpiece 2 is prevented from being taken off from the one workpiece 1. For example, since the tips of both locking arms 3 and 4 are brought into contact with the base wall 18 of the other workpiece 2, the other workpiece 2 is prevented from being further pushed.

Where the force of releasing the completely locked stale of FIG. 4 is acted on both workpieces 1 and 2, the complete locking arm 4 is supported as a normal beam since the outer face 11*a* is in contact with the inner slope 21 of the second guide 7 as both workpieces 1 and 2 are pushed into each other. Therefore, great force is required to warp the complete locking arm 4. This prevents the complete locking from being released inadvertently.

The complete locking can be released by pulling both workpieces by the force greater than that required for releasing the provisional locking so that the workpieces 1 and 2 are shifted into the provisional locking state shown in FIG. 2.

In accordance with this embodiment, the complete locking force can be improved and the intermediate warping hole in the conventional locking arm is not required. This permits the locking arms 3, 4 and arm receiving portion 5 to be molded forcibly from a mold in resin molding. The molding die is simplified and the production cost can be reduced.

Figure 5:
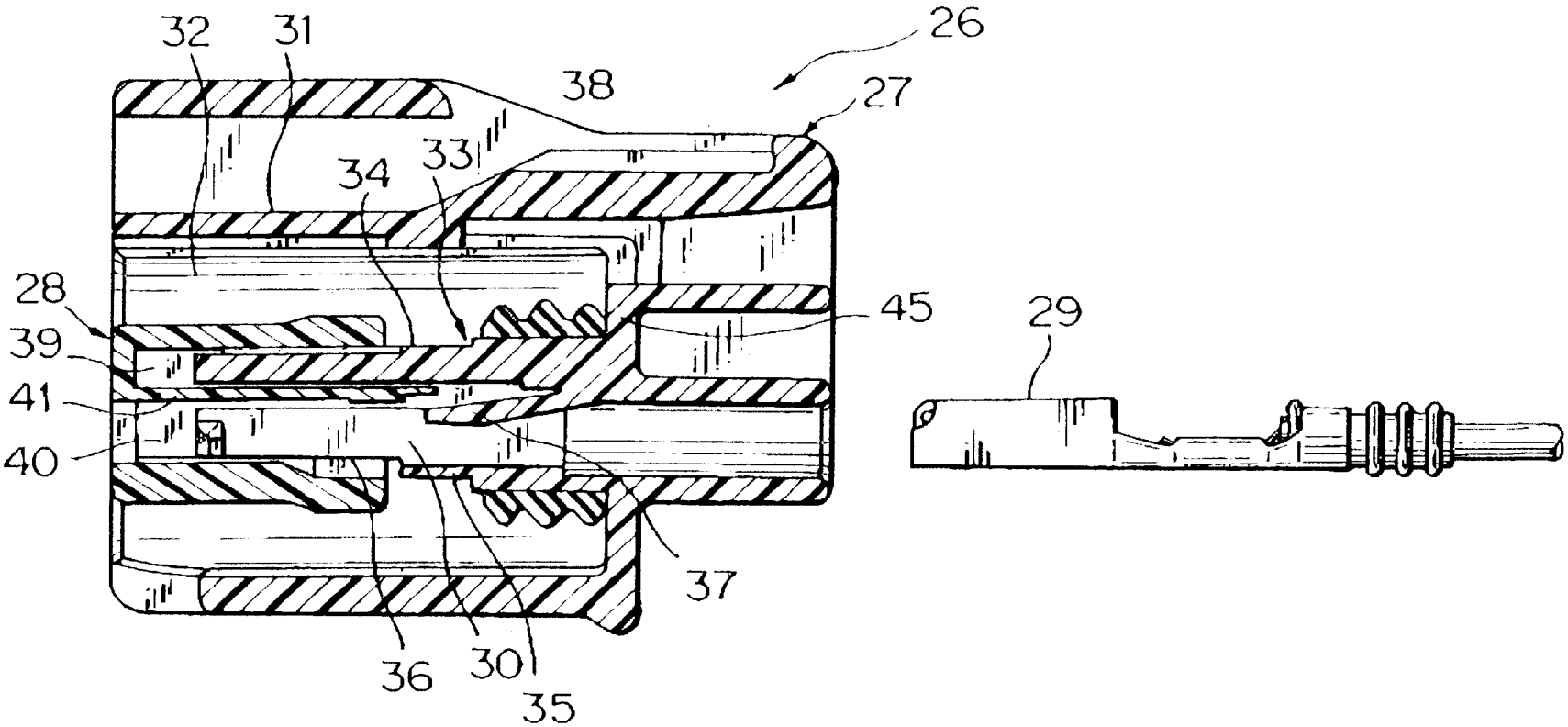
FIG. 5 is a longitudinal sectional view of an example of the holder-equipped connector to which the above locking structure of two workpieces is applied.
Figure 6:
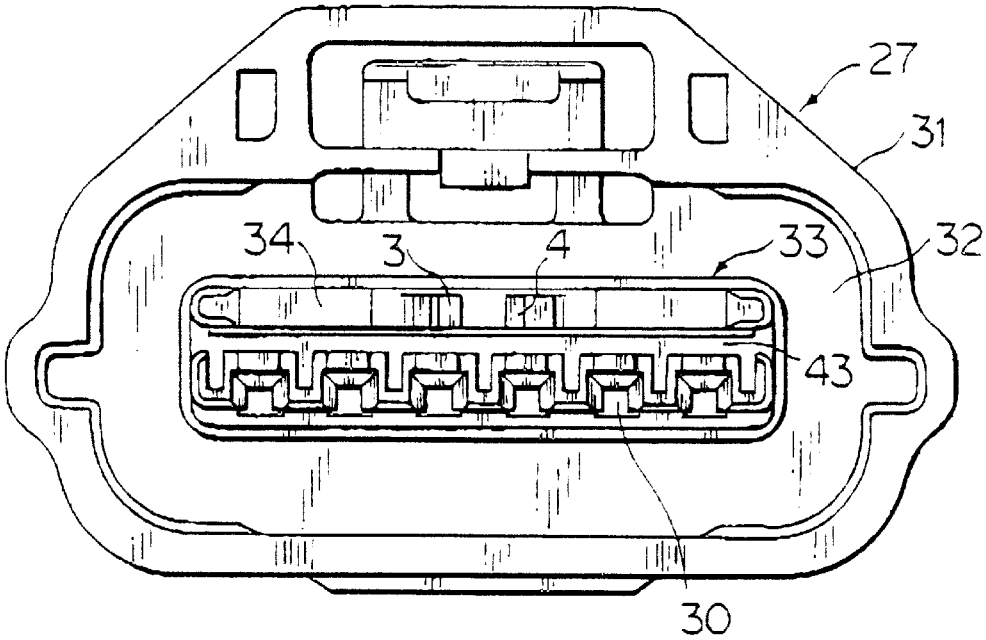
FIG. 6 is a front view of the connector housing.
Figure 7:
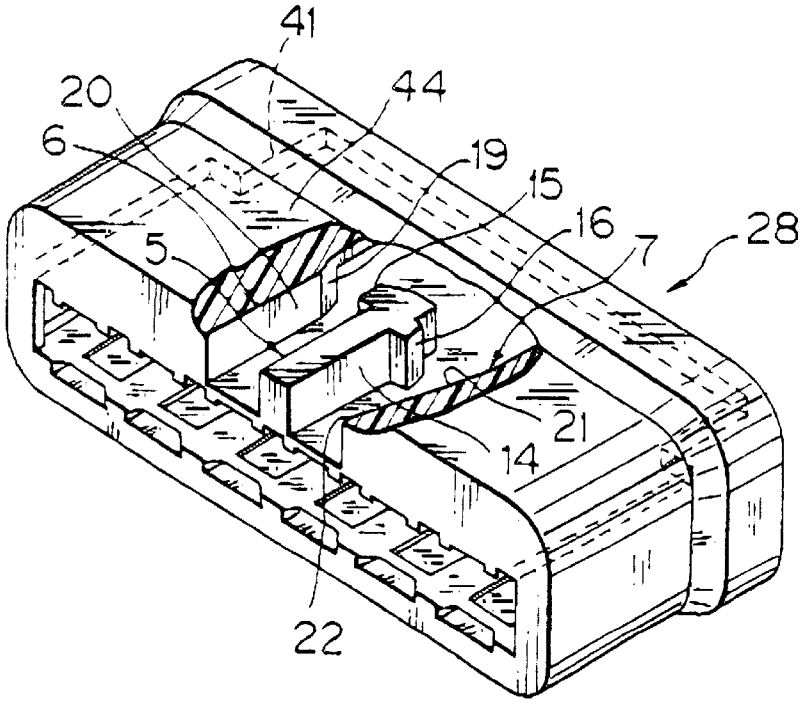
FIG. 7 is a partially recessed perspective view of a front holder of the connector.
Figure 8:
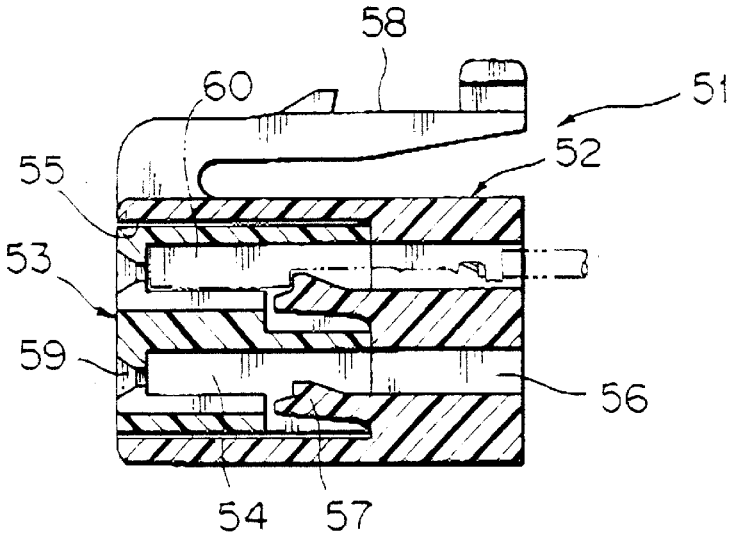
FIG. 8 is a longitudinal sectional view of a conventional holder-equipped connector.
Figure 9:
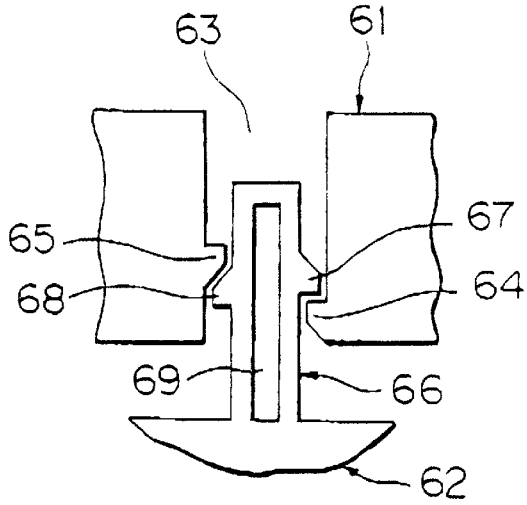
FIG. 9 is a plan view of the provisional locking state of a conventional locking structure of two workpieces.
Figure 10:
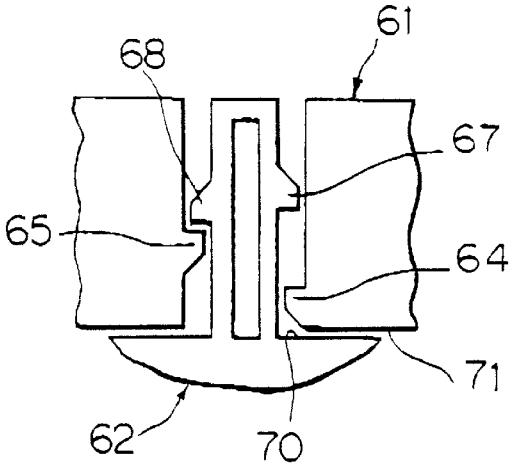
FIG. 10 is a plan view of the complete locking of the conventional structure.

Referring to FIGS. 5 to 7, an explanation will be given of an application of the locking structure shown in FIGS. 1 to 4.

FIG. 5 shows an embodiment of a holder-equipped connector. A holder-equipped connector 26 includes a male connector housing 27 of synthetic resin which serves as the one workpiece, a front holder 28 of synthetic resin which serves as the other workpiece combined with the connector housing 27 from the front to form a terminal chamber 30, and a wire-equipped female terminal 29 which is inserted from the rear into the connector housing 27.

The connector housing 27 includes a hood 31 and a housing body 33 arranged within an internal space 32 of the hood 31. The housing body 33 is composed of a horizontal upper wall 34, a short lower wall 35, a vertical partition 36 and a resilient terminal locking lance 37. A waterproof packing 38 for a complementary female connector (not shown) is mounted on the base of the housing body 33.

A front holder 28 is formed in a square-ring shape so as to have upper and lower slit-like vacant chambers 39, 40 and a plate wall 41 arranged therebetween to stop the warping of the lance. The upper wall 34 of the housing body 33 is adapted to advance into the upper vacant chamber 39 and the partition 36 is adapted to advance into the lower vacant chamber 40.

The pair of left and right horizontal locking arms 3 and 4 (FIG. 1) are attached on the upper wall 34 of the housing body 33. The arm receiving portion 5 (FIG. 1) and the pair of arm guides 6 and 7 (FIG. 1) which correspond to the locking arms 3 and 4 are provided in the upper vacant chamber 39 of the front holder 28. In the state as shown in FIG. 5, the front holder 28 is provisionally locked by these locking means 3 to 5.

FIG. 6 is a front view of the connector housing 27. The housing connector 27 includes the housing body 33 within the internal space 32 of the hood 31. The pair of left and right locking arms 3 and 4 are integrally attached to the upper wall 34 of the housing body 33. The locking arms 3 and 4 are formed flush with the upper wall 34 to cut out the center of the upper wall 34. The locking arms 3 and 4 can warp horizontally. A space 43 is formed beneath the locking arms 3 and 4 so that it can accommodate the plate wall 41 for stopping the warp of the locking lance of the front holder (FIG. 5). Below the space 43, a terminal accommodating space which constitutes terminal chambers is formed.

FIG. 7 is a perspective view of the front holder 28 of which the main part is recessed. The above arm receiving portion 5 is integrally formed between an upper wall 44 and the plate wall 41 for stopping the warp of the lance. The arm receiving portion 5 is composed of a square bar-like receiving body 14 which extends straight in a terminal inserting direction or holder inserting direction and the provisional engaging projection 15 and complete engaging projection 16 which are separately formed on both sides of the tip.

The first arm guide 6 is formed on the one side of the arm receiving portion 5. The first arm guide 6 has a straight face 20 in parallel to the receiving body 14 and a short slope 19.

The second arm guide 7 is formed on the other side of the arm receiving portion 5. The second arm guide 7 has a long slope 21 and a short straight face 22. The arm receiving portion 5 and the arm guide portions 6, 7 are formed as walls which couple the upper wall 44 and plate wall 41 with each other.

By weakly pushing the front holder 28 into the connector housing 27, as shown in FIG. 5, the front holder 28 is surely provisionally locked into the connector housing 27 with the aid of the provisional engaging protection 15 of the arm receiving portion 15 and the provisional locking projection 8 of the provisional locking arm 3. In this state, the terminal 29 is inserted and secured in the connector housing 27. Subsequently, by strongly pushing the front holder 28 into the connector housing in a direction opposite to that of inserting the terminal 29, the front holder 28 is surely completely locked into the connector housing 27 by strong locking force with the aid of the complete engaging projection 16 of the arm receiving portion 5 and the complete locking projection 12 of the complete locking arm 4.

FIGS. 5 to 7 show an application of the locking structure to a male connector 26. On the other hand, where the locking structure is to be applied to a female connector (not shown), for example, the pair of arms 3 and 4 are horizontally formed to project without employing the upper wall 34 of the housing body 33. The arm receiving portion 5 of the front holder 28 is formed integrally to the plate wall 41 in a space with the upper wall recessed. The structure of each of these locking arms 3, 4, arm receiving portion 5 and arm guides 6, 7 is exemplary, and can be modified according to the form of the workpiece such as the connector housing 27 and front holder 28.

Further, in FIG. 1, the pair of locking arms 3, 4 may be attached to the front holder 2 whereas the arm receiving portion 5 and arm guides 6, 7 may be attached to the connector housing 1. The locking structure shown in FIG. 1 can be applied to an electric connection box, rear holder, etc. (not shown) other than the connector housing 1 and front holder 2.

Incidentally, the contents to Japanese Patent Appln. No. 2001-232009 filed on Jul. 31, 2001 are hereby incorporated by reference.

What is claimed is:

1. A structure for locking two workpieces comprising:

a first workpiece provided with a provisional locking arm and a complete locking arm which are in parallel; and a second workpiece provided with an arm receiving portion having a provisional engaging area and a complete engaging area which are to be engaged with said provisional locking arm and said complete locking arm, respectively and a pair of arm guiding portions on both sides of the arm receiving portion, said arm receiving portion being to advance in between said provisional locking arm and said complete locking arm, wherein one of said arm guiding portions is provided with a slope for slidably supporting a tip of said complete locking arm when said complete locking arm climbs over the complete engaging portion.

2. A locking structure according to claim 1, wherein said provisional locking arm has a provisional locking area at its tip, said complete locking arm has a complete locking area at its middle position in he longitudinal direction, said arm receiving portion has said provisional engaging area at its tip and said complete engaging area behind said provisional engaging area.

3. A locking structure according to claim 2, wherein said provisional locking arm and said arm guiding portion have releasing slopes at their tips, respectively.

4. A locking structure according to claim 1, wherein said provisional locking area and said complete locking area are formed as projections.

5. A locking structure according to claim 1, wherein said first workpiece is a connector housing and said second workpiece is a front holder which defines a terminal chamber in said connector housing.

* * * * *